US005495685A

United States Patent [19]

Labutin et al.

[11] Patent Number: 5,495,685

[45] Date of Patent: Mar. 5, 1996

[54] EXCAVATOR BUCKET

[75] Inventors: Viktor N. Labutin; Alfred R. Mattis; Sergei V. Shishaev, all of Novosibirsk; Vladimir N. Tsvetkov, Ekaterinburg; Alexandr V. Tolmachev, Ekaterinburg; Genrikh K. Boiko, Ekaterinburg, all of Russian Federation

[73] Assignees: Institut Gornogo Delsa Sibirskogo Otdelenia Akademii Nauk SSSR; Proizvodstvennoe Obidinenie Uralmash, Russian Federation

[21] Appl. No.: 491,029

[22] Filed: Jun. 16, 1995

Related U.S. Application Data

[63] Continuation of Ser. No. 217,226, Mar. 24, 1994, abandoned, which is a continuation of Ser. No. 901,263, Jun. 19, 1992, abandoned.

[30] Foreign Application Priority Data

Jun. 19, 1991 [RU] Russian Federation ..... 4942599

[51] Int. Cl.[6] ..... E02F 3/36

[52] U.S. Cl. ..... 37/446; 37/904; 37/379

[58] Field of Search ..... 37/444, 446, 447, 37/264, 341, 342, 379, 904

[56] References Cited

U.S. PATENT DOCUMENTS

| | | | |
|---|---|---|---|
| 3,113,390 | 12/1963 | Pewthers | 37/447 |
| 3,293,778 | 12/1966 | McAuliff . | |
| 3,305,953 | 2/1967 | Von Mehren et al. . | |
| 3,328,904 | 7/1967 | Voigt et al. . | |
| 4,625,438 | 12/1986 | Mozer . | |
| 4,704,812 | 11/1987 | Paramore | 37/447 |
| 4,959,915 | 10/1990 | Roussin et al. | 37/447 |
| 5,172,498 | 12/1992 | Wack | 37/904 |

FOREIGN PATENT DOCUMENTS

| | | |
|---|---|---|
| 972397 | 8/1975 | Canada . |
| 99240 | 11/1954 | U.S.S.R. . |
| 759659 | 9/1980 | U.S.S.R. . |

*Primary Examiner*—Eric K. Nicholson
*Assistant Examiner*—Spencer Warnick
*Attorney, Agent, or Firm*—Ladas & Parry

[57] ABSTRACT

A characteristic feature of the invention lies in that the striking and static teeth are so arranged on the working edge of the bucket that the distance between the axes of the striking teeth is (3.5–4.5)b while the distance from the working edge to the blade of the striking tooth exceeds the distance from said edge to the blade of the static tooth by (1–3)b where b=width of blade of the striking tooth.

3 Claims, 2 Drawing Sheets

EXCAVATOR BUCKET

This is a continuation of application Ser. No. 08/217,226 filed on Mar. 24, 1994, now abandoned, which is a continuation of application Ser. No.: 07/901,263 filed Jun. 19, 1992, now abandoned.

FIELD OF THE INVENTION

The present invention relates to mining industry and, more particularly to the active bucket of an excavator designed to move, convey and excavate rock and frozen ground.

PRIOR ART

Widely known in the prior art is an excavator bucket (SU, A, 616371) comprising side walls and a bottom with a lip rigidly connected thereto and having intercommunicating sockets installed in which are teeth with a provision for reciprocating axially under the effect of springs and liquid pressure.

Cutting into rock, bucket teeth are subjected to nonuniform load which aggravates their wear. At the same time, hydraulic fluid utilized in this design makes it possible to redistribute the loads on the teeth and to raise efficiency of excavation.

However, all the teeth of the bucket are static and, as actual operation of this design has shown, the forces created by said teeth for digging and working of hard rocks prove to be inadequate.

Also known in the prior art is an excavator bucket (U.S. Pat. No. 4,625,438) comprising a body whose front edge has a number of teeth individually operated by air drives. This design of the bucket makes it suitable for working hard rocks.

However, operation of such a bucket is noted for a high specific power consumption. Investigations have shown that cutting off frozen ground with wedge-shaped tools spaced at small distances from one another fails to produce ridges. If distance between tools increases, this results in a nondestroyed ridge whose height grows with the increased distance; in this case reciprocal effect of teeth during chipping ceases and there appear two independent traces of destruction.

Thus, if it is desired to produce a straight face without nondestroyed ridges, the striking teeth must be installed on the front edge of the bucket at sufficiently small distances from one another. Hence, the number of axially reciprocating striking teeth depends solely on the width of the bucket and the energy consumption can be reduced by the specific design features of air hammers which actuate the axially reciprocating striking teeth.

The excavator bucket more closely approaching the disclosed invention (SU, A, 99240) comprises a body accommodating an air distributor in the form of a short pipe connected to which rigidly on one side is the main air conduit while on its other side there are pipes whose external ends carry axially reciprocating or movable (active) teeth arranged between conventional rigidly secured (static) teeth spaced along the cutting (working) edge of the bucket.

Alternation of axially reciprocating or movable and static teeth reduces loading of the striking (active) teeth and cuts down their total number in the bucket which impairs its energy consumption.

The striking and static teeth in the above-described design are installed on one and the same level and interact with the worked rock simultaneously. As a result, the static teeth come to bear against the nondestroyed ridge of rock simultaneously and the bucket stops working since digging forces of the excavator prove insufficient. The axially reciprocating striking teeth cannot start operating and the process of face working ceases.

DISCLOSURE OF THE INVENTION

The main object of the invention is to provide an excavator bucket with an optimum arrangement of axially reciprocating striking and static teeth on its working edge.

Another object of the invention resides in ensuring a minimum consumption of energy in operation.

A still further object of the invention is to step up excavating efficiency by increasing reliability of bucket design.

These and other problems are solved by providing an excavator bucket comprising a body whose working edge has striking teeth interposed between static teeth wherein, according to the invention, the axially reciprocating striking and static teeth are so arranged on the working edge that the distance between the axes of striking teeth is (3.5–4.5)$\underline{b}$ and the distance from the working edge to the blade or cutting edge of the static tooth is larger than the distance from said edge to the blade or cutting edge of the static tooth by (1–3)$\underline{b}$ where $\underline{b}$ is the width of the striking tooth blade or cutting edge.

This construction of the excavator bucket ensures creation of requisite forces for guaranteed digging of rock mass at a minimum consumption of energy.

BRIEF DESCRIPTION OF THE DRAWINGS

Now the invention will be elucidated by a concrete embodiment of its realization with reference to the accompanying drawings, in which.

BEST MODE OF CARRYING OUT THE INVENTION

Figure 1:
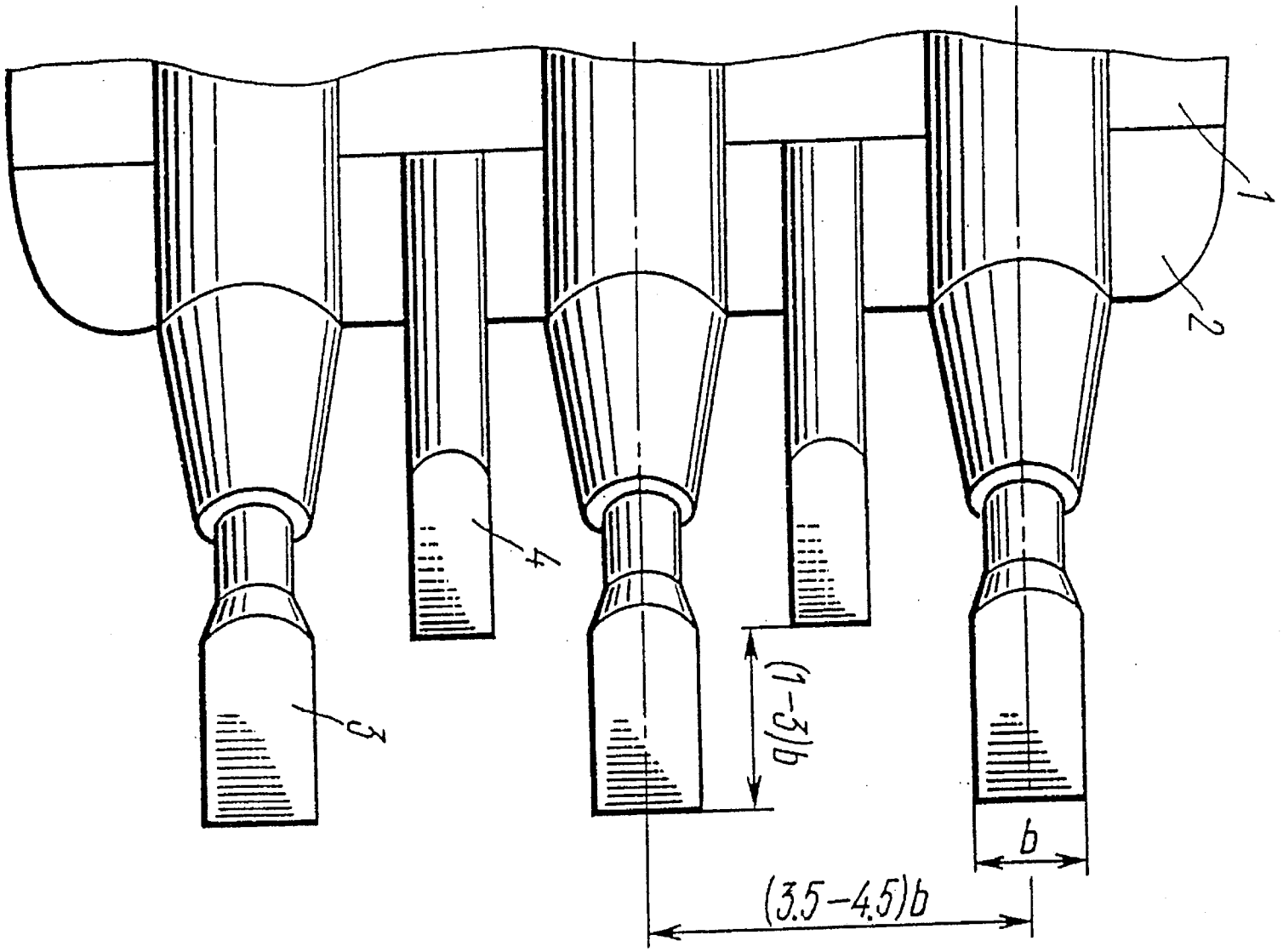
FIG. 1 is a schematic diagram of the working edge of the excavator bucket with striking and static teeth.

The excavator bucket comprises a body 1 (FIG. 1) whose working edge (2) is fitted with striking (3) and static (4) teeth. The static teeth (4) are interposed between the striking teeth (3) so that the distance between the axes of the striking teeth is equal to (3.5–4.5)$\underline{b}$. The distance between the working edge (2) of the bucket to the blade or cutting edge of the striking tooth (3) is larger than the distance from said edge to the blade or cutting edge of the static tooth (4) by (1–3)$\underline{b}$ where $\underline{b}$ is the width of the blade or cutting edge of the striking tooth. As shown in FIG. 1, the axes of the striking (3) and static (4) teeth are substantially parallel to each other. Furthermore, as shown in FIG. 1, the sides of the striking (3) and static (4) teeth as viewed from above are substantially parallel to the axes of said respective teeth (3, 4).

The disclosed mechanism functions as follows.

Figure 2:
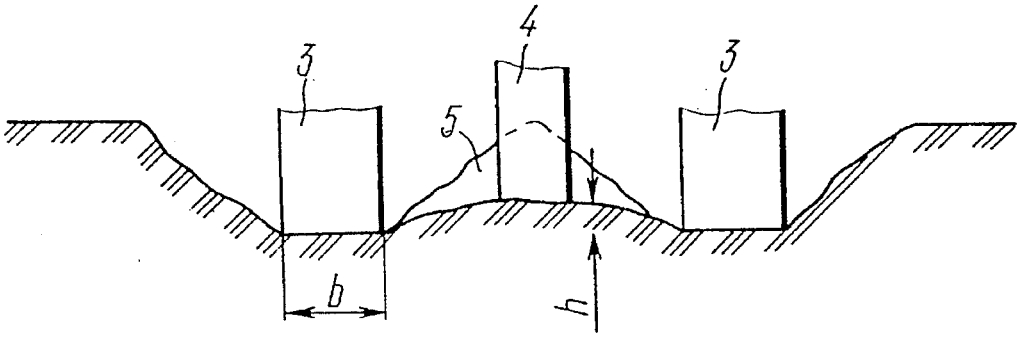
FIG. 2 is a schematic diagram of layer-by-layer digging of working face.
Figure 3:
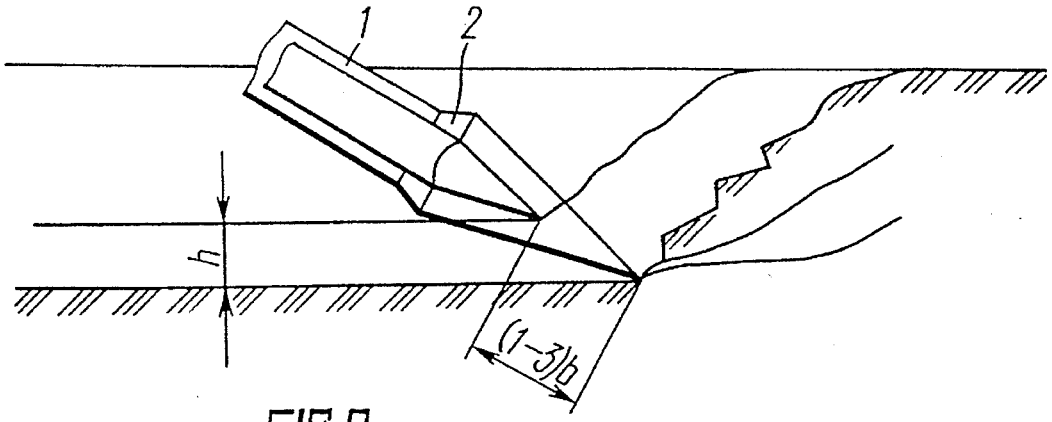
FIG. 3—same as in FIG. 2, side view.

The excavator bucket is lowered on the rock mass. The striking teeth (3) come to bear against rock (FIG. 2). As soon as the force on each striking tooth exceeds the force required for switching on the driving air hammer the latter starts axially reciprocating striking the tooth which penetrates to a certain depth into rock being worked. At the point of contact between the blade of the tooth (3) and rock the latter is crushed, forming a compact core. The forces originated by pressure in said core produce cracks in the rock, extending towards the exposed surface. Cracking develops not only along the motion of the working tool but in all directions from it, thus producing a loose zone in the rock, said zone being wider than the width of the tool. If two or more striking teeth are working simultaneously, cracks originating in their zone of action cross one another, producing a loose ridge 5 between the teeth 3. Inasmuch as the distance between the axes of the striking teeth varies within (3.5 and 4.5b, relative influence of said teeth weakens the ridge 5 and ensures its height sufficient for breaking it with the static teeth 4. As soon as the striking teeth 3 have penetrated (1–3b deep into rock, the static teeth 4 come into action. Inasmuch as the striking teeth are advanced by (1–3b from the static teeth, in the plane of bucket motion the static tooth comes in contact with the pillar already loosened by the striking teeth 3. The excavator bucket is directed at an angle to the rock mass being worked (FIG. 3), therefore the zone of action of the blade of the static tooth 4 will be higher than said zone of the striking tooth 3 by the value ofh whereh is the height of the nondisturbed portion of the pillar remaining after operation of the striking tooth. The same effect will be produced if the static teeth are set higher than the striking teeth relative to the working edge 2 of the bucket by the value ofh.

The operating plane of the static teeth 4 passes through the cracked zone located higher than the plane of action of the striking teeth 3. However, the striking teeth 3 and the static teeth 4 are aligned on the body 1 in substantially the same plane. The cutting forces of the static tooth diminish considerably so that these pillars can be excavated by the forces originated by the main excavator drives.

During subsequent operation of the striking teeth 3 the nondisturbed pillar is loosened, the striking teeth continue working the rock mass while the static teeth 4 act on the cracked zone of said pillar after which the layer-by-layer breaking of rock mass goes on in the same sequence.

The use of the present invention reduces considerably the power requirement of the excavator by installing a smaller number of the striking teeth in the bucket which ensures guaranteed working of the rock mass.

What is claimed is:

1. An excavator bucket comprising:

a body with a working edge;

at least two striking teeth for breaking up rock, each of said at least two striking teeth having a cutting edge and being mounted on said body for reciprocal movement along the longitudinal axis of each striking teeth, adjacent striking teeth being spaced from each other along said working edge at a distance sufficient to form a ridge of rock in which there are cracks weakening it, the distance between the longitudinal axes of at least two adjacent striking teeth being determined by the relationship (3.5 . . . 4.5)b, where b is the width of said cutting edge of a striking tooth;

static teeth having the purpose of breaking up the upper part of the rock ridge formed by adjacent striking teeth, said static teeth being rigidly mounted with respect to said body and the number of which is one less than the number of said at least two striking teeth, each of said static teeth having a cutting edge and being positioned between said at least two adjacent striking teeth so that the cutting edges of the static and striking teeth lie in substantially the same plane passing through the longitudinal axes of the adjacent striking teeth, wherein the cutting edge of a static tooth is spaced rearwardly from the cutting edge of the striking tooth a distance determined by the relationship (1 . . . 3)b.

2. An excavator bucket according to claim 1, wherein the axes of the striking teeth and of the static teeth are substantially parallel.

3. An excavator bucket according to claim 1, wherein the sides of the striking teeth and of the static teeth as viewed from above are substantially parallel to the axes of said respective teeth.

* * * * *